United States Patent [19]

Voegele, Jr.

[11] 4,087,940

[45] May 9, 1978

[54] TOP HINGED SASH ASSEMBLY

[76] Inventor: William P. Voegele, Jr., 8308 Post Rd., Allison Park, Pa. 15101

[21] Appl. No.: 757,019

[22] Filed: Jan. 5, 1977

[51] Int. Cl.[2] ..... E05D 7/00

[52] U.S. Cl. ..... 49/397; 49/324

[58] Field of Search ..... 49/397, 501, 356, 354, 49/324; 52/460, 463

[56] References Cited

U.S. PATENT DOCUMENTS

| | | | |
|---|---|---|---|
| 605,681 | 6/1898 | Schwing | 49/356 X |
| 1,050,073 | 1/1913 | West | 49/324 X |
| 1,748,555 | 2/1930 | Kinney | 49/324 X |
| 2,823,773 | 2/1958 | Kubatzky et al. | 49/397 X |
| 2,884,056 | 4/1959 | Kubatzky et al. | 49/397 X |
| 3,266,192 | 8/1966 | Kolm | 49/397 |
| 3,534,501 | 10/1970 | Carlsson et al. | 49/397 |
| 3,802,127 | 4/1974 | Silvernail | 49/397 |

*Primary Examiner*—Philip C. Kannan
*Attorney, Agent, or Firm*—Webb, Burden, Robinson & Webb

[57] ABSTRACT

A top hinged swinging sash assembly includes a hinge bar adapted for securement to a building girt, said hinge bar including a substantially J-shaped hinge rail. A frame assembly comprising a head member, a sill member, two or more vertical mullions and two side flashing members is joined to the hinge bar through a curved, beaded head rail extending from the head member. The spaced, vertical mullions connect between the head and sill members with flat or corrugated panels being retained between the mullions and mullion caps mounted thereto. Operators connect to the frame and preferably to the mullions or sills to cause the frame to swing out from the hinge bar. In a preferred embodiment the mullions include a planar forward surface having a hub extending outward therefrom to define oppositely extending channels. These channels accommodate flat panels or in the case of the end mullions accommodate the side flashing members in interlocking relationship. The operator is preferably a rack and pinion with the rack arm thereof terminating in a pivotal connection with the rear portion of the mullion. The frame members are preferably made of extruded aluminum, extruded plastic or formed sheet metal.

17 Claims, 7 Drawing Figures

TOP HINGED SASH ASSEMBLY

FIELD OF THE INVENTION

My invention is directed to a sash assembly and, more particularly, to a top hinged swinging sash assembly intended for use in industrial, residential or commercial applications.

DESCRIPTION OF THE PRIOR ART

Top hung swinging industrial sashes and pivotal hinges therefor have been utilized with panels or windows for many years. Exemplary of such constructions are U.S. Pat. Nos. 2,565,200 and 2,138,816. Various attempts have been made to improve the hinge connection of such windows, U.S. Pat. No. 3,633,244, and window frames have been suggested which include a plurality of fixed and operable windows arranged in side-by-side relationship and including a plurality of vertical mullions spaced therealong, U.S. Pat. No. 3,802,127.

There still remains a need for a top hinged swinging sash assembly which is strong enough for industrial applications and which at the same time is easy to install either on new buildings or on existing buildings. Often times sash assemblies must be custom made for existing buildings since standard items do not include the flexibility of being secured vertically or horizontally or accommodating corrugated or planar panels. In addition, the operator normally connects to the sill which, therefore, limits the vertical placement thereof. Further, existing top hinged swinging panel constructions are slightly inclined from the vertical in the closed position because of the spaced relationship between the hinge rail and the frame.

I have provided a strong and durable top hinged swinging sash assembly which is easily inserted into a hinge bar which in turn can be secured vertically or horizontally to a building girt. The mullions accept corrugated or planar panels and the end mullions accommodate the side flashing of the side frame members in positive interlocking relationship. The panel hangs perfectly vertical in the closed position. The operator, while normally connected to the mullion, can be also connected to the sill if there are space limitations.

As a result of these advantages, my top hinged swinging sash assembly is very flexible, finding application in industrial, residential or commercial environments. In addition, it can be easily installed in new or existing buildings. Properly positioned weather stripping insures an air-tight weather seal in the closed position. My construction is easily operated either manually or mechanically and maintenance is minimized with panels being replaceable without removing the frame. My panel construction is effective as a single unit or as a plurality of units covering extremely long or wide open spaces. In addition, optional operator positioning eliminates the problem of interference with building columns. The split mullion embodiment permits the joining of several individual panels to form large panels continuous in width and consistent in strength and appearance.

My sash assembly comprises an extruded or formed double angle hinge bar having an integral drip cap and a substantially J-shaped hinge rail. The frame assembly includes an extruded or formed head member, an extruded or formed sill member and two extruded or formed side members connected in rectangular relationship. The frame assembly is connected to the hinge bar through a curved and beaded head rail extending upwardly from the head member. A plurality of vertically extending, extruded or formed mullions is spaced between the head and sill members and includes a hub defining channels on opposing sides thereof to accommodate the panel. The channels of the end mullions (side members) accommodate side flashing members in interlocking relationship. Vertically extending mullion caps are mounted to the mullion hub so as to retain the panel between the mullions and mullion caps within the frame assembly. An operator is secured to the frame preferably at the mullions so as to operate the swinging panel construction. Split mullions and intermediate framing are provided for large frame assemblies to facilitate the joining of several smaller panels into one large panel. Intermediate sill brackets are provided to accept the operators in cases where building columns interfere with the preferred operator securement.

DESCRIPTION OF THE PREFERRED EMBODIMENTS

Figure 1:
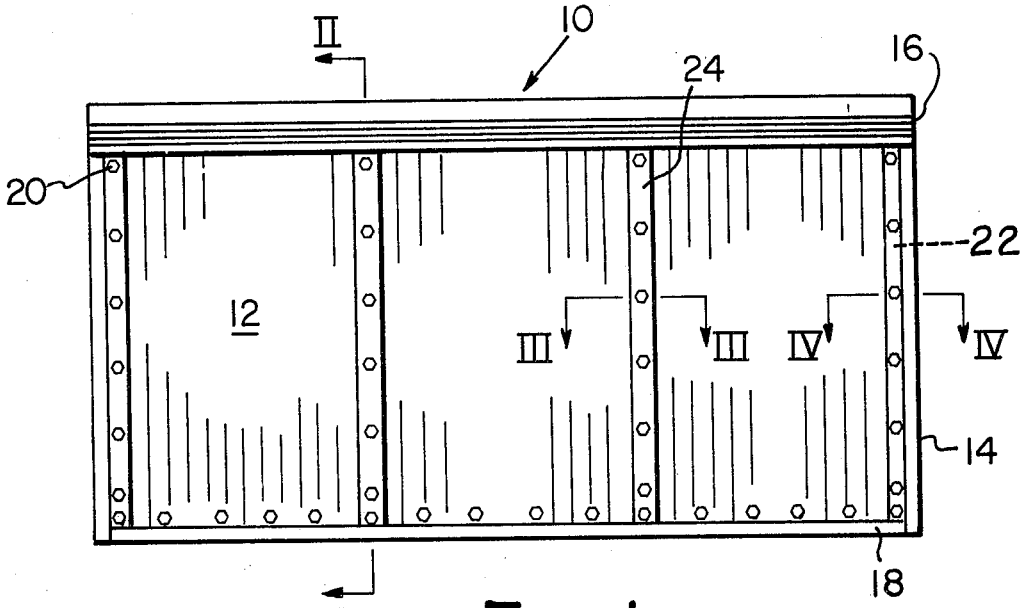
FIG. 1 is an elevation of my hinged swinging sash assembly.

My sash assembly, generally designated 10, is of the top hung awning type having a hinged swinging panel. The sash assembly 10 includes a frame comprised of a main head extrusion 16, two side member extrusions 14 and an extruded bottom sill 18 joined in substantially rectangular relationship, FIG. 1. A panel 12 or plurality of panels 12 form part of the sash assembly 10. The frame member portions of the sash assembly 10 are normally made of metal extrusions of aluminum or the like and the panel 12 is normally plastic, fiberglas or some other similar material which may be flat or corrugated. The frame members may also be extruded plastic or sections formed from sheet metal and the term extrusion or member is used generically hereinafter. The panel may be clear, translucent or opaque or may even be insulated for certain applications. The panel may thusly be of single or double wall construction. The sash assembly finds primary use in industrial or commercial applications, but it may also be used in less demanding applications such as residential. The frame may also be used with other sash types by providing appropriate side hinging, pivoting or projection hardware.

Figure 2:
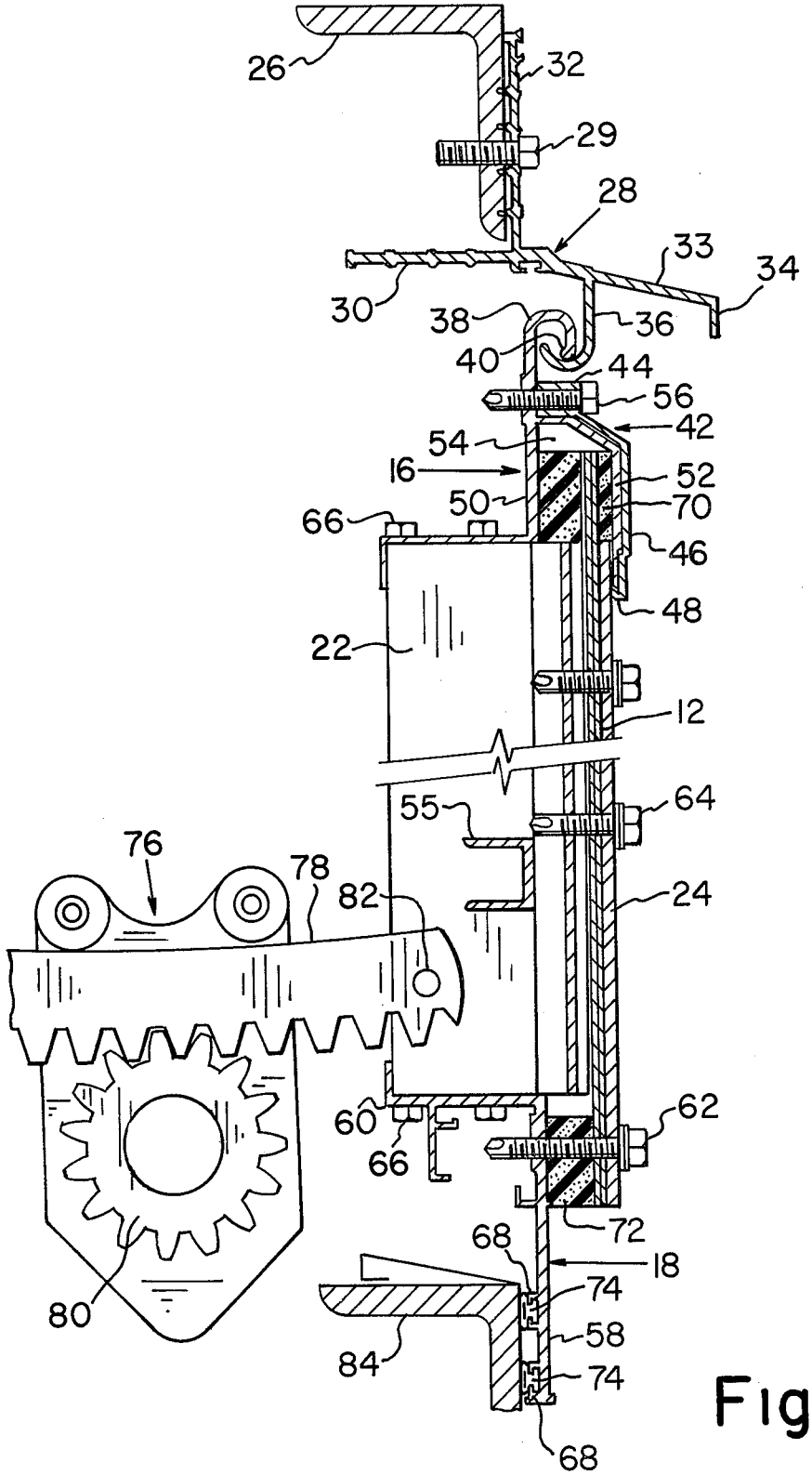
FIG. 2 is a broken section taken along lines II—II of FIG. 1.

The main head extrusion 16 comprises a double bent, rearward leg 50 and a forward leg 52 extending therefrom so as to define a channel 54 therebetween, FIG. 2. Leg 50 terminates in a curved, upside down U-shaped head rail 38 having an enlarged bead 40 at its distal end. The head rail 38 is positioned in the hinge rail 36 to be described hereinafter.

The hinge rail 36, which is substantially J-shaped, forms a part of the hinge bar 28, FIG. 2. Hinge bar 28 includes a substantially horizontal leg 30 which includes an inclined portion 33 which terminates in a drip cap 34. Extending upward from horizontal leg 30 is upright leg 32. Both upright leg 32 and horizontal leg 30 are apertured to accommodate a threaded fastener 29 for connection to a building girt 26. In FIG. 1, the hinge bar 28 is secured to the building girt 26 through the upright leg 32. In a similar manner, the hinge bar 28 could be attached along its horizontal leg 30. In other words, the double angles permit vertical or horizontal attachment depending on the nature of the building girts. The hinge rail 36 extends downwardly from the inclined portion 33 of leg 30 to readily accommodate the mating head rail 38 of the main head extrusion 16. The hinge rail 36 is offset from the vertical leg 32 so that the frame hangs in a perfectly vertical position when closed. Leg 32 is in alignment with the vertical portion of leg 50 of main head extrusion 16.

The channel 54 in the main head extrusion 16 accommodates the panel 12 with a foam closure 70 positioned on at least one side of panel 12 within channel 54, FIG. 2.

A keeper extrusion 42 maintains the head rail 38 within the hinge rail 36. Specifically, keeper extrusion 42 includes an apertured neck 44 through which a threaded fastener 56 secures the keeper 42 firmly to the double bent leg 50. Extending from the apertured neck 44 is a flexible leg 46 which terminates in a hook 48 which is positioned about the end of leg 52 of the main head extrusion 16. When in place, keeper extrusion 42 serves as a blockage to prevent the separation of the head extrusion 16 from the hinge bar 28 and specifically to assure the continued engagement between curved legs 36 and 38 of the respective extrusions.

The main head extrusion 16 is connected at its ends to the end most vertical mullions 22, FIG. 1. The side flashing extrusions 14 in turn are clamped in place by the edge of the cover cap extrusion 24, and additionally are secured along their inner edge in a positive interlocking relationship with the mullion extrusion 22, FIG. 4. Extending vertically between the head and sill extrusions 16 and 18, respectively, in spaced relationship is a plurality of additional vertical mullions 22. A horizontally extending intermediate structural girt 55 connects to the mullions 22 to give additional support for vertically long panels, FIG. 2. The panels 12 are retained against the mullions 22 by mullion caps 24.

Specifically, the bottom sill 18 includes a vertical leg 58 containing two apertured, integral lugs 68 which accommodate vinyl weather sealing 74 for engagement with the bottom building girt 84 or sill or flashing in the fully closed position, FIG. 2. Extending from vertical leg 58 is an L-shaped leg 60. The mullion 22 extends between the L-shaped leg 60 of the bottom sill 18 and the double bent leg 50 of the main head extrusion 16. The mullion 22 is secured to these two members by threaded fastener 66. The mullion cap 24 holds panel 12 against the sill 18 by means of a threaded fastener 62 extending through the panel 12 and the foam closure 72 and into threadable engagement with vertical leg 58. A plurality of screws 64 likewise secure the mullion cap 24 into the mullion 22, with the panels 12 held therebetween.

The sash assembly 10 is generally moved into its opened and closed position through an operator 76, FIG. 2. This operator 76 may be a variety of types including the rack and pinion illustrated in the subject application, or the operator could likewise be a lever arm or a chain type. The power source for the operator 76 may be a simple hand lever, chain powered, a hand crank or electrical power in which a motor and gear drive are utilized. The operator 76 preferably connects to the mullions 22 through operator arm 78 and pivot pin 82.

The mullion construction of my invention provides substantial flexibility both as to the operator connection and the panel type. Specifically, mullion 22 is also an aluminum extrusion, FIGS. 3 and 4. Mullion 22 includes a forward planar surface 88 having a central hub 90 extending outward therefrom. Hub 90 has two ribs 92 extending out from opposite directions and parallel to planar surface 88 so as to form channels 94 on either side of the hub 90 between the respective ribs 92 and the planar surfaces 88. These channels 94 can be utilized to accommodate a flat panel 12' illustrated by dotted lines in FIG. 3. The respective end mullions 22 along the sash assembly 10 accommodate the side flashing 98 of the side member extrusion 14 within the channel 94 in interlocking relationship.

Figure 3:
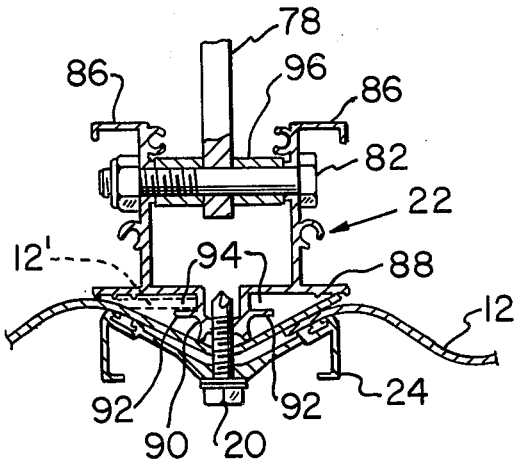
FIG. 3 is a section taken along lines III—III of FIG. 1.
Figure 4:
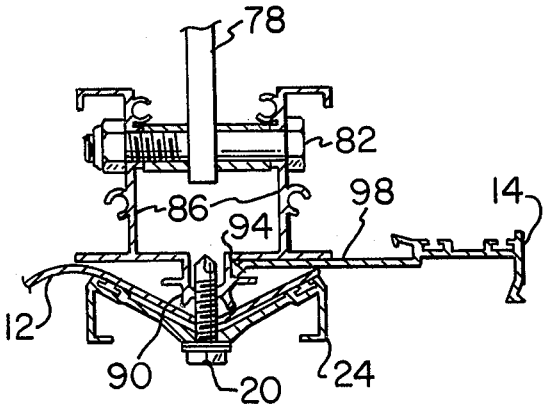
FIG. 4 is a section taken along section lines IV—IV of FIG. 1.

Formed integrally with mullions 22 and extending rearward from planar surface 88 are two parallel legs 86 in spaced relationship, FIGS. 3 and 4. The parallel legs 86 are apertured so as to accommodate a threaded pivot pin 82. The rack arm 78 of the operator 76 terminates between the parallel legs 86 and is retained there by the threaded pivot pin 82. Spacer bushings 96 are used between the rack arm 78 and the respective legs 86 to maintain the spaced relationship. The rack arm 78 is then driven by an appropriate pinion 80 in the standard manner, FIG. 2.

The mullion caps 24 which assist in holding the panels 12 against the mullions 22 are secured to the mullions 22 by means of threaded fasteners 20 extending through the mullion cap 24, the panel 12 and into hubs 90 of the mullions 22, FIGS. 1–3.

Figure 5:
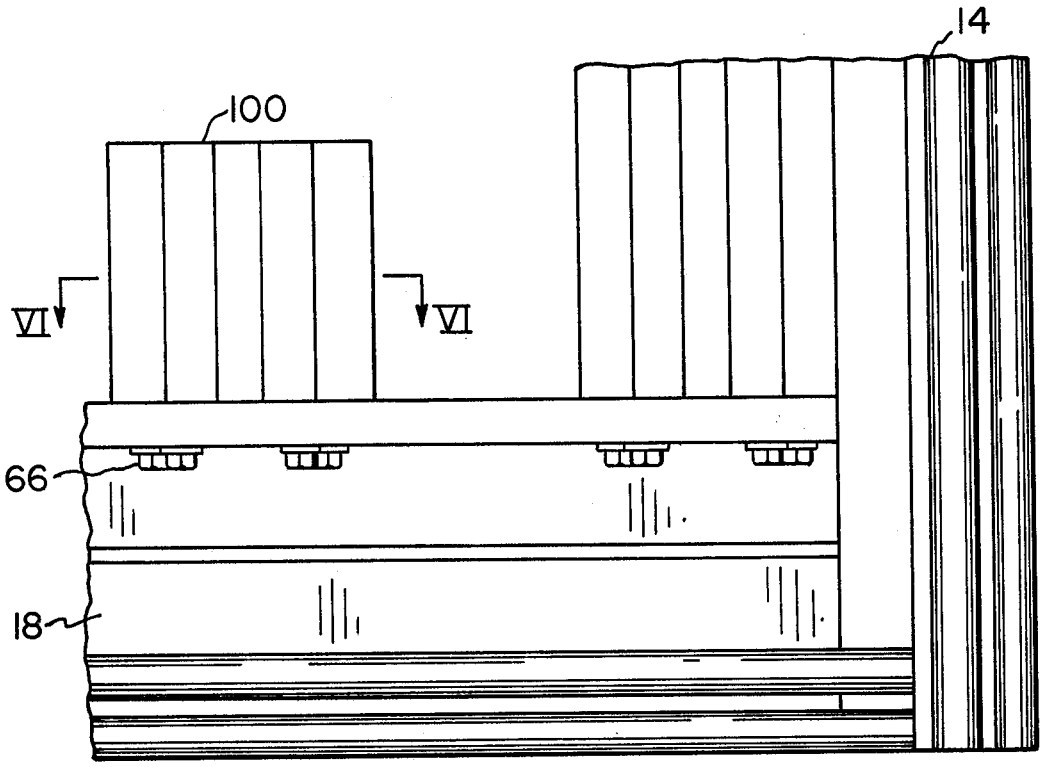
FIG. 5 is a broken away elevation showing a side member and bottom sill connection.
Figure 6:
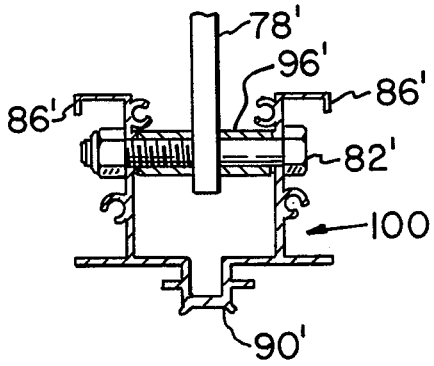
FIG. 6 is a section taken along section lines VI—VI of FIG. 5.
Figure 7:
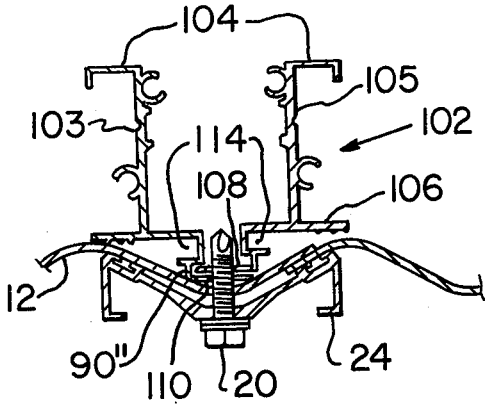
FIG. 7 is a section through a split mullion in joined position with the mullion cap in place.

When obstructions, e.g. building columns, occur behind the sash assembly 10 such that a rack arm cannot be attached to a mullion, a short piece of mullion, termed sill station 100, is utilized, FIGS. 5 and 6. Sill station 100 is secured to the sill 18 by threaded fasteners 66. The sill station 100 is positioned adjacent a mullion where there will be adequate access to the backside thereof for the attachment of an operator. Sill station 100 includes the hub 90' and the two parallel legs 86' through which a rack arm 78' is pivotally connected by threaded pivot pins 82', , FIG. 6. The rack arm 78' is held is spaced relationship to the parallel legs 86' by means of spacer bushings 96'. The sill station 100 is illustrated as being adjacent a side extrusion 14 in FIG. 5.

Where there is a demand to cover a very long open space with a continuous panel run, split mullions 102 may be employed, FIG. 7. Split mullion 102 comprises two mullion components 103 and 105, each containing a planar surface 106 and a leg 104 extending rearwardly therefrom. In addition, each component 103 and 105 includes a portion of the hub 90''. Specifically, component 103 includes apertured hub leg 110 which is positioned in overlapping relationship to apertured hub leg 108 of component 105, the apertures being threaded and positioned in alignment. The two components 103 and 105 of mullion 102 are positioned together with the respective panels 12 also being positioned in overlapping relationship. Thereafter, the mullion cap 24 is screwed into the hub 90'' by inserting fastener 20 into the aligned apertures of the two overlapping legs 108 and 110, respectively, FIG. 7. This permits continuous panel runs of extended lengths. The operator connection provides opening of these continuous panel runs and a full 70 degree opening is possible. This provides maximum light and ventilation for ventilating skylights as well as for side wall sash.

I claim:

1. A top hung hinged sash construction comprising:

A. a hinge bar adapted for securement to a building girt and including a substantially J-shaped hinge rail depending downward therefrom;

B. a frame assembly comprising a head member, a sill member, two side members and spaced vertical mullions mounted between the head and the sill member and at least one panel all joined in substantially rectangular relationship, said head member including an upwardly extending leg terminating in a curved beaded head rail positioned in swinging engagement with the hinge rail, said mullions having a planar forward surface, a hub extending outward therefrom, said hub including oppositely extending arms parallel to and spaced from the forward surface to form channels therebetween to accommodate a side flashing member or a flat panel in positive interlocking relationship and mullion caps mounted to at least certain of the mullions to retain the panel therebetween; and C. an operator connected to the frame to cause the frame to swing about the hinge bar.

2. The construction of claim 1, said hinge bar including a first leg adapted for securement to the girt and a second leg offset from the first and including the hinge rail.

3. The construction of claim 1 including a horizontally extending structural girt connected to said mullions intermediate their ends.

4. The construction of claim 1 including insulating means, said head member including two downwardly spaced and parallel legs to define a channel to accommodate the panel and said insulating means.

5. The construction of claim 1, said mullion being formed by two sections, each section including a portion of the hub, one of the arms and one of the channels, said sections positioned with their respective hub portions in overlapping relationship and joined by a threaded fastener extending through the mullion cap and through said overlapping portions.

6. The construction of claim 1 including a sill station mounted to the sill member adjacent a mullion, said operator connecting to said sill station, said sill station including two rearwardly extending parallel and spaced legs to accommodate the operator therebetween.

7. The construction of claim 1, said side members being vertical mullions.

8. The construction of claim 3 including side flashing members retained at least in part by said side member vertical mullions.

9. The construction of claim 1, said hinge bar comprising a substantially horizontal leg, a first leg extending vertically upward therefrom, a second leg spaced from the first leg and extending vertically downward from the horizontal leg and including the hinge rail, both the first leg and horizontal leg adapted for securement to the building girt.

10. The construction of claim 5, said substantially horizontal leg terminating in a drip cap.

11. The construction of claim 5, said upwardly depending leg of the head member being in spaced and vertical alignment with said hinge bar first leg.

12. The construction of claim 1, said mullion including two parallel and spaced arms extending rearward from the forward surface, said arms accommodating the operator.

13. The construction of claim 10, said operator connected to a plurality of mullions.

14. The construction of claim 11, said operator comprising a rack and pinion, said rack having a rack arm terminating between the two parallel and spaced mullion arms and a threaded fastener extending through the arms and the rack arm to form a pivotal connection therebetween, said arms maintained in parallel and spaced relationship through spacer bushings.

15. The construction of claim 11 including a keeper member mounted to the head member to form a blockage to retain the head rail within the hinge rail.

16. A top hung hinged sash construction comprising:

A. an extruded hinge bar having a substantially horizontal leg terminating in a drip cap, a first leg extending vertically upward from the horizontal leg, a second leg spaced from the first leg and extending vertically downward from the horizontal leg, said second leg terminating in a substantially J-shaped hinge rail, at least one of the first and second legs adapted for securement to a building girt;

B. a frame assembly comprising an extruded head member, an extruded sill member and two extruded side mullions joined in substantially rectangular relationship, said head member including an upwardly extending leg terminating in a curved and beaded head rail for positioning in swinging and mating engagement with the hinge rail, said side mullions each having a flashing extrusion secured thereto;

C. a plurality of vertically extruded mullions spaced intermediate the side mullions and extending between the head and sill members, all said mullions having a hub defining channels on opposing sides thereof, said channels of the side mullions accommodating the side flashing extrusions in interlocking relationship;

D. panels positioned within the frame between the mullions;

E. vertical mullion caps mounted to the mullion hubs so as to secure the panels therebetween; and F. operator means connected to the mullions to swing the frame assembly between an open and closed position.

17. In a sash assembly for opening and closing a frame forming a part thereof, the improvement comprising said frame including a head member, a sill member, a plurality of spaced and vertical mullions extending between said head and sill members, certain of said mullions being end mullions to form a rectangular frame, said mullions having a planar forward surface, a hub extending outward therefrom, said hub including oppositely extending arms parallel to and spaced from the forward surface to form channels therebetween, panels extending between mullions within said channels, vertical mullion caps mounted to the mullion hubs so as to secure the panels within the channels and means mounted to the frame for said opening and closing.

* * * * *